US005823013A

United States Patent [19]

Lonati et al.

[11] Patent Number: 5,823,013

[45] Date of Patent: Oct. 20, 1998

[54] KNITTED TUBULAR COMPONENTS WITH FORM-FITTING POUCH AND METHODS FOR MANUFACTURING SAME

[75] Inventors: Francesco Lonati; Tiberio Lonati; Ettore Lonati; Fausto Lonati, all of Brescia, Italy

[73] Assignee: Lonati S.p.A, Monza, Italy

[21] Appl. No.: 835,560

[22] Filed: Apr. 8, 1997

[30] Foreign Application Priority Data

Apr. 22, 1996 [IT] Italy ..... MI96A0790

[51] Int. Cl.[6] ..... D04B 1/24

[52] U.S. Cl. ..... 66/177; 66/176

[58] Field of Search ..... 66/54, 176, 177, 66/178 R; 2/69

[56] References Cited

U.S. PATENT DOCUMENTS

| | | | |
|---|---|---|---|
| 2,052,784 | 9/1936 | Martin | 66/176 |
| 3,256,716 | 6/1966 | Hänel . | |
| 3,479,844 | 11/1969 | Silvain | 66/176 |
| 3,553,981 | 1/1971 | Kuney . | |
| 3,566,624 | 3/1971 | Burleson . | |
| 3,599,241 | 8/1971 | Rossler | 2/240 |
| 4,068,320 | 1/1978 | Machacek et al. | 2/227 |
| 4,341,095 | 7/1982 | Poteat | 66/177 |
| 4,412,433 | 11/1983 | Safrit et al. | 66/177 |
| 4,663,946 | 5/1987 | Wright | 66/177 |
| 4,875,241 | 10/1989 | Browder et al. | 2/409 |
| 5,115,650 | 5/1992 | Patrick et al. | 66/169 A |
| 5,431,030 | 7/1995 | Ishizaki et al. | 66/176 |
| 5,605,060 | 2/1997 | Osborne | 66/171 |

FOREIGN PATENT DOCUMENTS

| | | |
|---|---|---|
| 1 490 120 | 11/1967 | France . |
| 2 611 981 | 10/1976 | Germany . |

*Primary Examiner*—Andy Falik

*Attorney, Agent, or Firm*—Guido Modiano; Albert Josif; Daniel J. O'Byrne

[57] ABSTRACT

A method for producing tubular components, particularly for manufacturing hosiery or other items of clothing with a shaping effect by using circular knitting or hosiery-making machines, and a tubular component obtained with the method. The method consists in forming, during the production of the tubular component, certain portions of rows of knitting, for some rows, with a greater loop length than the preceding rows, the subsequent rows, and the remaining portions of the rows themselves, in order to form at least one lateral pouch along the extension of the tubular component.

25 Claims, 3 Drawing Sheets

KNITTED TUBULAR COMPONENTS WITH FORM-FITTING POUCH AND METHODS FOR MANUFACTURING SAME

BACKGROUND OF THE INVENTION

The present invention relates to a method for producing tubular components for manufacturing hosiery or other items of clothing with a shaping effect by using circular knitting or hosiery-making machines, and to a tubular component obtained with said method.

In recent years there has been an increasing demand, particularly on the part of women, for items of clothing having a shaping effect, i.e., which perform a supporting action in certain regions of the body, correcting and improving the aesthetics of the figure.

In the field of hosiery, particularly of the pantyhose type, hosiery items are commercially available which have regions, such as for example the region at the hips, the region directly below the buttocks, and the front region of the abdomen, knitted with reinforced or prestretched elastic threads, so as to effectively support these parts of the body, which are subject more than others to unaesthetic accumulations of fat.

However, the mere supporting effect of these items of clothing, by consisting merely of a compression of the underlying body tissues, is not able to achieve considerable shaping, since the tissues compressed in one region tend to expand in the neighboring regions at random, giving the figure a deformed appearance if the part of the item of clothing that is reinforced or knitted with prestretched elastic threads is limited to a single region of the circumferential extension of said item of clothing.

If instead the portion that is reinforced or knitted with elastic thread runs fully around the figure of the user, upon prolonged use the user is subject to discomfort caused mainly by the compression to which the body tissues are subjected, hindering normal blood circulation.

SUMMARY OF THE INVENTION

A principal aim of the present invention is to provide a method that allows to produce components for manufacturing hosiery or other items of clothing that have a considerable shaping effect on the figure of the user.

Within the scope of this aim, an object of the invention is to provide a method that allows to produce components for manufacturing hosiery or other items of clothing in which the shaping effect is achieved without causing discomfort to the user.

Another object of the invention is to provide a method that can be performed with conventional circular knitting or hosiery-making machines.

This aim, these objects, and others that will become apparent hereinafter are achieved by a method for producing tubular components, particularly for manufacturing hosiery or other items of clothing with a shaping effect by using circular knitting or hosiery-making machines, characterized in that during the production of the tubular component certain portions of rows of knitting, for some rows, are formed with a greater loop length than the preceding rows, the subsequent rows, and the remaining portions of said rows, in order to form at least one lateral pouch along the extension of the tubular component.

BRIEF DESCRIPTION OF THE DRAWINGS

Further characteristics and advantages of the invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

With reference to the above figures, the method for producing tubular components on a circular knitting or hosiery-making machine according to the invention consists in producing, during the production of a tubular component 1, given portions of rows of knitting, for some rows, with a greater loop length than the preceding rows, the subsequent rows, and the remaining portions of said rows, so as to form at least one lateral pouch 2 along the extension of the tubular component.

More particularly, the method according to the invention consists in producing a tubular component 1, in a per se known manner, by providing, in given regions of the component, portions of rows in which the loops are longer. The increased length of the loops in the region that provides the lateral pouch 2 at the end of the production of the tubular component can be achieved by acting on the lowering cams of the circular knitting or hosiery-making machine by means of devices for adjusting the length of the loops, i.e., the tightness of the knitting being formed, for example by means of a device known from U.S. Pat. No. 4,712,390 filed Dec. 5, 1985. This patent discloses a device that allows to vary as required the length of the loops of knitting being formed by moving the lowering cam related to a feed of the machine parallel to the axis of the needle cylinder. In performing the method according to the invention, this increase in the length of the loops, during the formation of a row of knitting, is limited to a portion of the row being formed.

The number of loops along a same row affected by the increase in length can vary according to requirements, so as to obtain larger or smaller lateral pouches 2, along the circumferential extension of the rows, according to the requirements.

Figure 7:
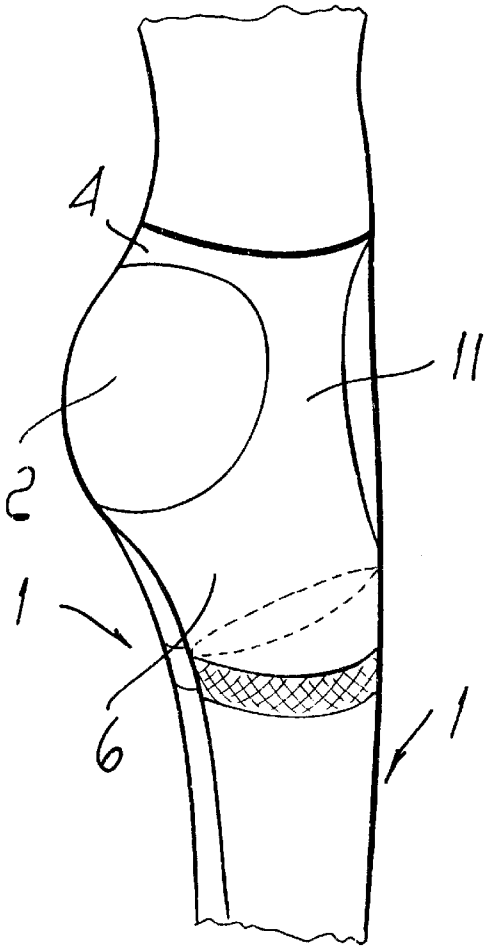
FIG. 7 is a view of the shaping effect obtained with the pantyhose shown in FIG. 1.
Figure 1:
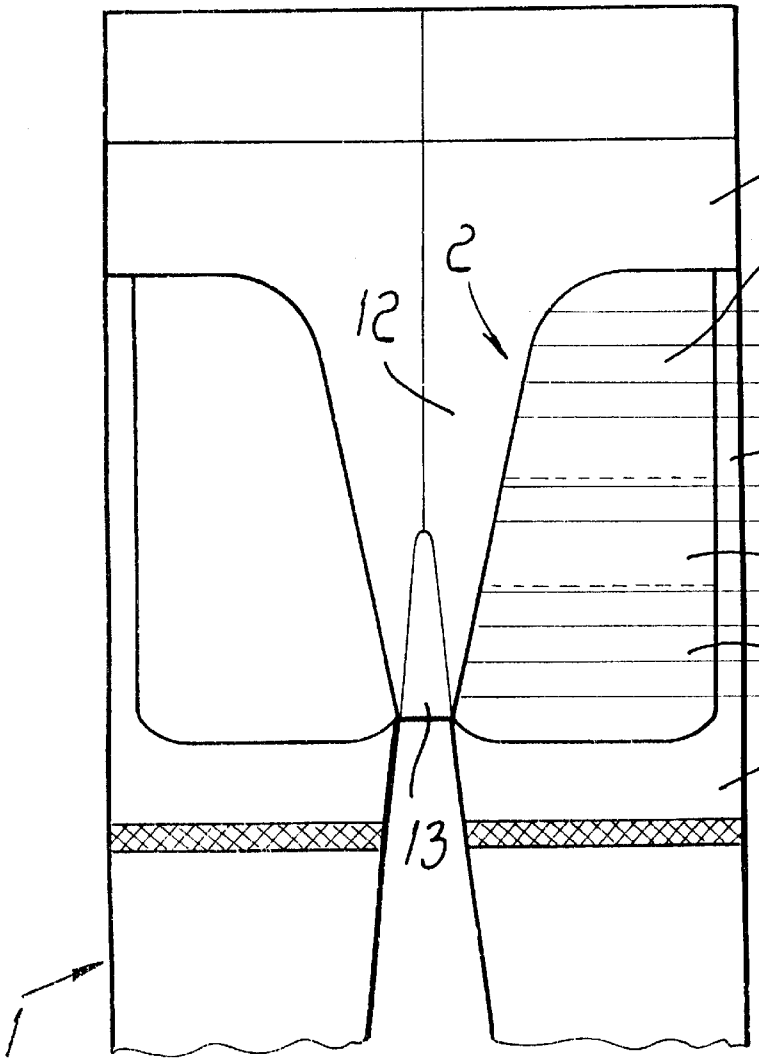
FIG. 1 is a schematic view of a hosiery item of the pantyhose type, taken from the rear side and formed by joining two tubular components produced with the method according to the invention.
Figure 2:
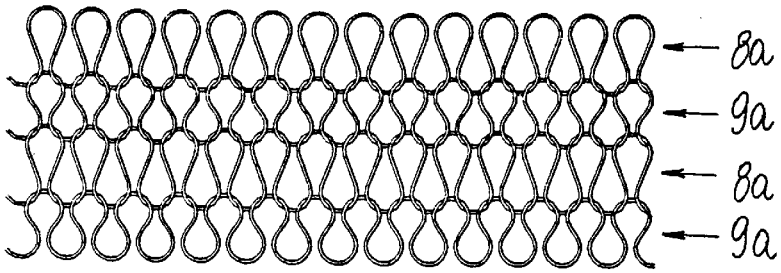
FIG. 2 is an enlarged-scale view of a detail of the portion A of FIG. 1.
Figure 3:
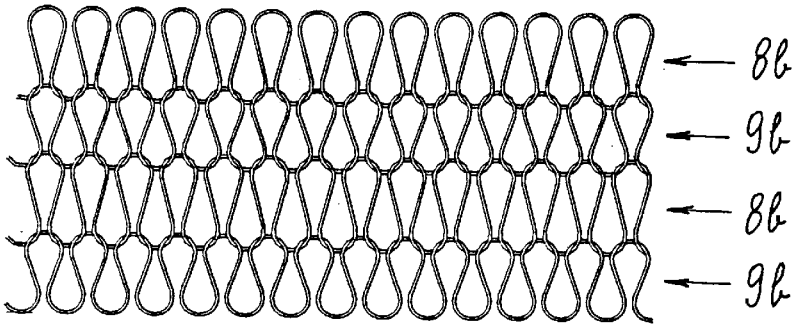
FIG. 3 is an enlarged-scale view of a detail of the portion B of FIG. 1.
Figure 4:
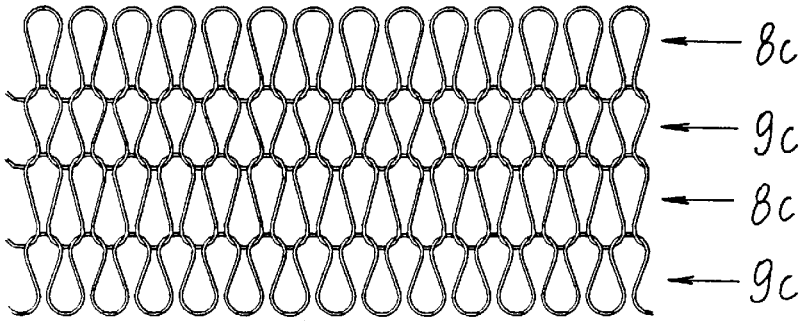
FIG. 4 is an enlarged-scale view of a detail of the portion C of FIG. 1.
Figure 5:
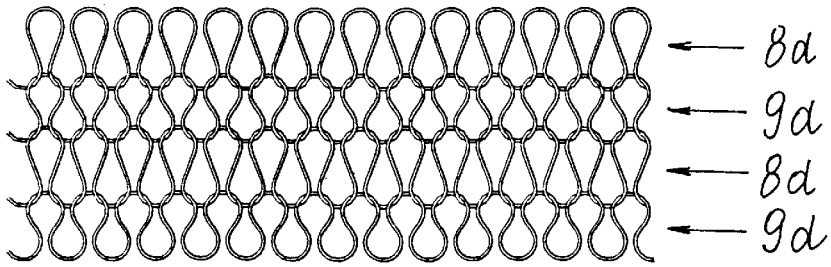
FIG. 5 is an enlarged-scale view of a detail of the portion D of FIG. 1.

Preferably, during the formation of the lateral pouch 2 the length of the loops of knitting at the lateral pouch 2, i.e., at the row portions that form said pouch 2, is increased gradually row by row at the beginning of the knitting of the pouch 2, which corresponds to the region 3 in FIG. 1, to blend the pouch 2 with the previously formed part 4 of the tubular component 1.

In the same manner, during the formation of the final part of the pouch 2, which corresponds to the region 5 in FIG. 1, the length of the loops of knitting, in the row portions that form the pouch 2, is decreased gradually, row by row to blend the pouch 2 with the part 6 of the component to be formed after knitting the pouch 2.

During the formation of the part 7 of the component, which is arranged between the parts 3 and 5, the row portions that form the pouch 2 are knitted with loops the length whereof is increased but constant row by row.

Conveniently, as shown in particular in FIGS. 2 to 5, during the formation of the pouch 2, row portions 8*a*, 8*b*, 8*c*, 8*d* are formed which are alternated, row by row, with row portions 9*a*, 9*b*, 9*c*, 9*d* having shorter or longer loops. In practice, during the formation of the pouch 2, during the formation of a row, a portion of said row is formed with longer loops than the remaining part of said row; during the formation of the very next row, once again a row portion is formed wherein the loops are longer than in the remaining part of the same row, at the longer loops of the previously formed row, but are shorter than the longer loops of the previous row; the following row is formed, at the portion with longer loops, so as to have loops that are longer than the other loops of the same row but longer than the longer loops of the previously formed row, and so forth. In practice, by analyzing the tubular component exclusively with reference to the pouch 2, there are row portions 9*a*–9*d* with shorter loops alternated with row portions with longer loops 8*a*–8*d*. These shorter loops, too, are in any case longer than the remaining part of the corresponding row, in order to cooperate with the loops of the other rows in forming the lateral pouch 2.

In forming the pouch 2, the row portions 9*a*–9*d* formed by shorter loops, which as mentioned are alternated with row portions 8*a*–8*d* having longer loops, are produced with a thread having a greater elasticity than the thread used to produce the row portions 8*a*–8*d* formed by longer loops, with which they alternate. In this manner, a controlled supporting effect is obtained at the pouch 2 owing to the fact that the shorter loops, being made of a more elastic thread, can adapt, during the use of the tubular component 1, to the greater length of the loops produced with a more rigid thread.

Figure 6:
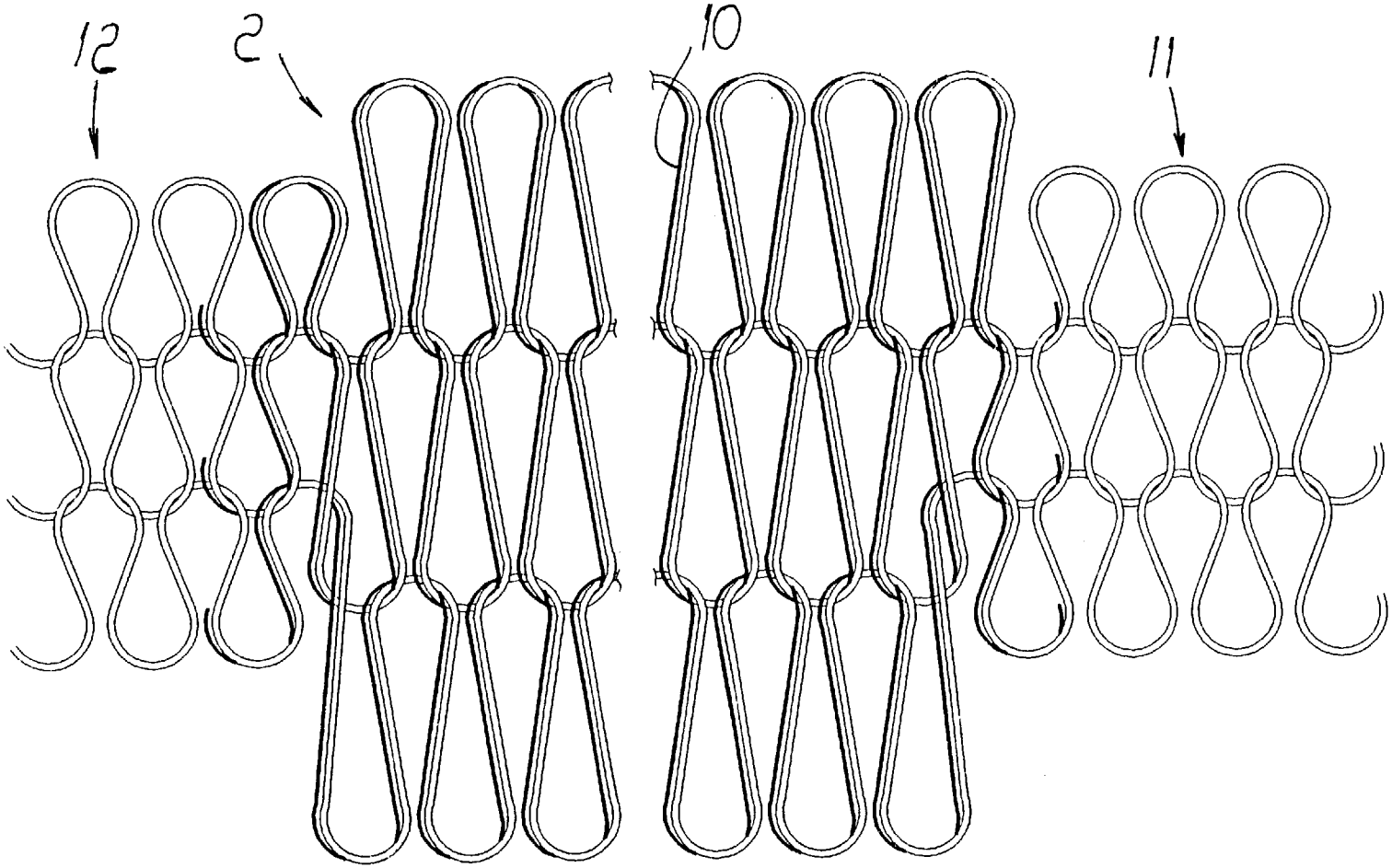
FIG. 6 is an enlarged-scale view of the portion E of FIG. 1.

Furthermore, during the formation of the pouch 2, the row portions that form the pouch 2 are reinforced with an additional thread 10, which is shown only in FIG. 6 for the sake of simplicity. In this manner, control over the outward elastic deformability of the pouch 2 is achieved and the reduction in thickness and color of the hosiery item at the pouch 2, caused by the greater length of the loops that form it, is compensated.

Advantageously, the row portions and/or the rows that are contiguous to the pouch 2, which correspond to the regions 4, 6 and 11, 12 shown in FIG. 1, are produced with stretched and/or reinforced threads, in a per se known manner, in order to increase the supporting effect of the tubular component 1.

The supporting effect of the tubular component 1 in the regions close to the pouch 2 can also be achieved by knitting with held stitches in said regions.

The tubular component can be used directly to produce items of clothing such as hosiery, body stockings, or other underwear, or can be used, in a per se known manner, together with another tubular component 1, after cutting and sewing, with the optional insertion of a gusset 13 in the connecting region to form pantyhose-type hosiery, as shown in particular in FIG. 1.

In practice, the tubular component obtained with the method according to the invention has at least one lateral pouch 2 having the purpose of supporting and shaping the parts of the body that are subjected to a supporting action in regions of the component, such as for example the regions 4, 6, 11, and 12, that are close to the lateral pouch 2. In this manner it is possible, by means of a tubular component produced with the method according to the invention, to achieve a considerable shaping effect as a consequence of the combination of the supporting action applied by the portions 4, 6, 11, and 12 proximate to the lateral pouch 2 and of the controlled expansion allowed by said pouch 2.

Thus, for example, in the case of the production of pantyhose-type hosiery (see FIG. 1) it is possible to have a supporting effect in the region 6 directly below the buttocks and in the region 11 on the hips, which directs the parts of the body that are in excess in said regions towards the buttock region, whereat the pouches 2 are provided, with the effect of uplifting the buttocks that is particularly appreciated by users of these items of clothing.

Of course it is possible to provide one or more pouches 2 along the extension of the component in preset regions, according to the requirements, so as to obtain various kinds of shaping of the user's figure and also to have supporting actions alternated with less supporting regions, for example for the production of sports or sanitary-type hosiery.

In practice it has been observed that the method according to the invention fully achieves the intended aim, since it allows to provide tubular components, on circular knitting or hosiery-making machines, which can be used to produce hosiery, or other items of clothing, with a particularly conspicuous shaping effect.

It should be noted that the tubular component obtained with the method according to the invention does not cause discomfort to the user owing to the fact that it does not simply provide a supporting effect but provides a supporting effect in certain regions, shifting the excess part of the body to a region that is proximate to the compressed region and wherein the body parts can expand or at least be less compressed.

Although the method according to the invention has been conceived in particular for the production of tubular components meant to manufacture hosiery, it can nonetheless be used to produce tubular components meant for the manufacture of other items of clothing, such as for example body stockings, underpants, or the like, according to production requirements.

The method thus conceived is susceptible of numerous modifications and variations, all of which are within the scope of the inventive concept: all the details may furthermore be replaced with other technically equivalent elements.

What is claimed is:

1. Method for producing tubular components, for manufacturing hosiery or other items of clothing with a shaping effect by using circular knitting or hosiery-making machines, the method comprising the steps of:

knitting tubular component so as to form an extension of the tubular component having rows of knitting arranged in succession along the extension of the tubular component;

knitting selected portions of selected rows of knitting with a greater loop length than the loop length of the rows of knitting which precede said selected rows along the extension of the tubular component and than the loop length of the rows of knitting which follow said selected rows along the extension of the tubular component and than the loop length of the remaining portions other than said selected rows, in order to form at least one lateral pouch along the extension of the tubular component; and gradually increasing the length of the loops of knitting, in the selected row portions that form said pouch, row by row at the beginning of the knitting of said pouch in order to blend said pouch with the previously formed part of the tubular component.

2. Method according to claim 1, further comprising gradually decreasing the length of the loops of knitting, in the selected row portions that form said pouch, row by row at the end of the production of said pouch in order to blend said pouch with the part of the product to be formed after said pouch.

3. Method according to claim 1, further comprising forming first row portions of said selected row portions which are alternated, row by row, with second row portions of said selected row portions having longer or shorter loops.

4. Method according to claim 3, further comprising producing the row portions of said first and second row portions formed by shorter loops with a thread that is more elastic than the thread used to knit the row portions of said first and second row portions formed by longer loops.

5. Method according to claim 1, further comprising reinforcing said pouch with an additional thread.

6. Method according to claim 1, further comprising forming the row portions and/or the rows that are contiguous to said pouch with threads that are stretched and/or reinforced to increase the supporting effect of the tubular component.

7. Method according to claim 1, further comprising forming the row portions and/or the rows that are contiguous to said pouch with held stitches in order to increase the supporting effect of the tubular component.

8. Method according to claim 1, further comprising forming the row portions and/or the rows that are contiguous to said pouch with held stitches in order to increase the supporting effect of the tubular component.

9. Knitted tubular component, for producing hosiery items or other items of clothing having a shaping effect, comprising;

rows of knitting arranged in succession along an extension of the tubular component; and at least one lateral pouch that is formed by contiguous selected portions of selected rows of knitting that are constituted by loops that are longer than the loops of the rows and row portions that lie outside said lateral pouch;

and wherein the length of the loom of knitting in the selected row portions that form said pouch gradually increase row by row from one end of said pouch towards the center of the pouch.

10. Tubular component according to claim 9, wherein rows with longer loops and rows with shorter loops of said selected rows of knitting are alternated within said pouch.

11. Tubular component according to claim 10, wherein said rows with shorter loops are constituted by a thread that is more elastic than the thread constituting said rows with longer loops.

12. Tubular component according to claim 9, wherein said row portions that form said pouch are reinforced with an additional thread.

13. Tubular component according to claim 9, wherein the row portions and/or the rows of knitting that are contiguous to said pouch are composed of threads that are stretched and/or reinforced in order to increase the supporting effect of the component.

14. Tubular component according to claim 9, wherein the row portions and/or the rows of knitting that are contiguous to said pouch are knitted with held stitches in order to increase the supporting effect of the product.

15. Hosiery or clothing item having a shaping effect, comprising at least one tubular component which comprises:

rows of knitting arranged in succession along the extension of an tubular component; and at least one lateral pouch that is formed by contiguous selected portions of selected rows of knitting that are constitutedbly loops that are longer than the loops of the rows and row portions that lie outside said lateral pouch;

and wherein the length of the loops of knitting in the selected row portions that form said pouch gradually increase row by row from one end of said pouch towards the center of the pouch.

16. Hosiery item of the pantyhose-type, comprising two tubular components each of which comprises:

rows of knitting arranged in succession along an extension of the tubular component; and at least one lateral pouch that is formed by contiguous selected portions of selected rows of knitting that are constituted by loops that are longer than the loops of the rows and rows portions that lie outside said lateral pouch;

and wherein the length of the loops of knitting in the selected row portions that form said pouch gradually increase row by row from one end of said pouch towards the center of the pouch;

the two tubular components being mutually joined laterally proximate to one of their axial ends, said two tubular components having said lateral pouch at the buttocks region.

17. Method for producing tubular components, for manufacturing hosiery or other items of clothing with a shaping effect by using circular knitting or hosiery-making machines, the method comprising the steps of:

knitting a tubular component so as to form an extension of the tubular component having rows of knitting arranged in succession along the extension of the tubular component;

knitting selected portions of selected rows of knitting with a greater loop length than the loop length of the rows of knitting which precede said selected rows along the extension of the tubular component and than the loop length of the rows of knitting which follow said selected rows along the extension of the tubular component and than the loop length of the remaining portions other than said selected portions of said selected rows, in order to form at least one lateral pouch along the extension of the tubular component; and gradually decreasing the length of the loops of knitting, in the selected row portions that form said pouch, row by row at the end of the production of said pouch in order to blend said pouch with the part of the product to be formed after said pouch.

18. Method according to claim 17, further comprising forming first row portions of said selected row portions which are alternated, row by row, with second row portions of said selected row portions having longer or shorter loops.

19. Method according to claim 18, further comprising producing the row portions of said first and second row portions formed by shorter loops with a thread that is more elastic than the thread used to knit the row portions of said first and second row portions formed by longer loops.

20. Method according to claim 17, further comprising reinforcing said pouch with an additional thread.

21. Method according to claim 17, further comprising forming the row portions and/or the rows that are contiguous to said pouch with threads that are stretched and/or reinforced to increase the supporting effect of the tubular component.

22. Method for producing tubular components, for manufacturing hosiery or other items of clothing with a shaping effect by using circular knitting or hosiery-making machines, the method comprising the steps of:

knitting a tubular component so as to form an extension of the tubular component having rows of knitting arranged in succession along the extension of the tubular component;

knitting selected portions of selected rows of knitting with a greater loop length than the loop length of the rows of knitting which precede said selected rows along the extension of the tubular component and than the loop length of the rows of knitting which follow said selected rows along the extension of the tubular component and than the loop length of the remaining portions other than said selected portions of said selected rows, in order to form at least one lateral pouch along the extension of the tubular component; and forming the row portions and/or the rows that are contiguous to said pouch with threads that are stretched and/or reinforced to increase the supporting effect of the tubular component.

23. Knitted tubular component, for producing hosiery items or other items of clothing having a shaping effect, comprising;

rows of knitting arranged in succession along the extension of the tubular component; and at least one lateral pouch that is formed by contiguous selected portions of selected rows of knitting that are constituted by loops that are longer than the loops of the rows and row portions that lie outside said lateral pouch;

the row portions and/or the rows of knitting that are contiguous to said pouch being knitted with held stitches in order to increase the supporting effect of the product.

24. Method for producing tubular components, for manufacturing hosiery or other items of clothing with a shaping effect by using circular knitting or hosiery-making machines, the method comprising the steps of:

knitting a tubular component so as to form an extension of the tubular component having rows of knitting arranged in succession along the extension of the tubular component;

knitting selected portions of selected rows of knitting with a greater loop length than the loop length of the rows of knitting which precede said selected rows along the extension of the tubular component and than the loop length of the rows of knitting which follow said selected rows along the extension of the tubular component and than the loop length of the remaining portions other than said selected portions of said selected rows, in order to form at least one lateral pouch along the extension of the tubular component; and forming first row portions of said selected row portions which are alternated, row by row, with second row portions of said selected row portions having longer or shorter loops.

25. Method according to claim 24, further comprising producing the row portions of said first and second row portions formed by shorter loops with a thread that is more elastic than the thread used to knit the row portions of said first and second row portions formed by longer loops.

* * * * *